US005819811A

United States Patent [19]

Baker et al.

[11] Patent Number: 5,819,811

[45] Date of Patent: Oct. 13, 1998

[54] LOW AIR PERMEABILITY PAPERMAKING FABRIC SEAM

[75] Inventors: Samuel M. Baker, Carleton Place; Marc P. Despault, Ottawa; James D. Harrison, Kanata, all of Canada

[73] Assignee: JWI Ltd., Kanata, Canada

[21] Appl. No.: 845,458

[22] Filed: Apr. 25, 1997

[30] Foreign Application Priority Data

May 10, 1996 [GB] United Kingdom ..... 9609761

[51] Int. Cl.[6] ..... D21F 1/00; D03D 3/04

[52] U.S. Cl. ..... 139/383 AA; 442/203; 162/902; 139/383 A

[58] Field of Search ..... 442/215, 203, 442/216; 162/902, 348; 139/383 A, 383 AA, 425 A

[56] References Cited

U.S. PATENT DOCUMENTS

| | | | |
|---|---|---|---|
| 3,464,452 | 9/1969 | Brouwer . | |
| 4,290,209 | 9/1981 | Buchanan et al. . | |
| 4,318,469 | 3/1982 | Kufferath-Kassner . | |
| 4,423,755 | 1/1984 | Thompson | 139/383 A |
| 4,621,663 | 11/1986 | Malmendier | 139/383 A |
| 4,791,708 | 12/1988 | Smolens . | |
| 4,985,790 | 1/1991 | Komatsu et al. . | |
| 5,062,216 | 11/1991 | Hannigan . | |
| 5,089,324 | 2/1992 | Jackson . | |
| 5,407,737 | 4/1995 | Halterbeck et al. . | |
| 5,458,161 | 10/1995 | Scarfe . | |
| 5,597,450 | 1/1997 | Baker et al. | 139/383 A |
| 5,601,691 | 2/1997 | Kufferath . | |
| 5,613,527 | 3/1997 | Zimmermann et al. | 139/383 A |

FOREIGN PATENT DOCUMENTS

| | | |
|---|---|---|
| 0 580 478 | 1/1994 | European Pat. Off. . |
| 1510153 | 1/1967 | France . |
| 2178766 | 2/1987 | United Kingdom . |
| 2292755 | 3/1996 | United Kingdom . |

*Primary Examiner*—Andy Falik
*Attorney, Agent, or Firm*—Robert A. Wilkes

[57] ABSTRACT

A flat woven, pin seamed, papermakers' fabric, comprising primary warp monofilament yarns, primary weft monofilament yarns and secondary weft monofilament yarns located between and adjacent to the primary weft yarns. The secondary weft yarns are located beneath, and in contact with, the primary warp. The thickness and width of the secondary weft yarns are chosen at the weaving stage so as to control finished fabric air permeability and increase the paper side surface contact area. The fabrics are of a lower caliper, and provide increased cross direction stiffness at lower yarn counts. Formation of the pintle receiving loop yarns in a low marking woven back pin seam, or of a streamline seam, is also facilitated, without compromising fabric properties, by selection of the appropriate dimensions of the secondary weft yarns. The fabrics are woven using either round or flattened primary warp yarns, and either round or flattened monofilament primary weft yarns, or a combination thereof, according to any weave pattern which provides for floats of the primary warp yarns that extend over two or more adjacent primary weft.

14 Claims, 2 Drawing Sheets

LOW AIR PERMEABILITY PAPERMAKING FABRIC SEAM

FIELD OF THE INVENTION

The present invention relates to papermakers fabrics and particularly, but not exclusively, to fabrics for use in the dryer section of papermaking machines.

BACKGROUND OF THE INVENTION

A papermaking fabric, intended for use in pressing or drying sections of modern papermaking and like machines, is ideally of a low caliper, so as to minimize any surface velocity differences between the paper side and the machine side of the fabric arising as the moving fabric wraps around supporting cylinders having differing diameters. The fabric should provide a substantially flat planar paper side surface contact area, so as to offer adequate support for the paper sheet, and should have optimum dewatering and drying effectiveness. The fabric must also be dimensionally stable, so as to resist curl, wrinkle or lateral drift during operation, and have adequate cross machine direction stiffness so as to be resistant to damage caused by paper wads, and the like.

It is highly desirable that the fabric air permeability be relatively easy to control during manufacture so that the fabric can be constructed to satisfy the known end use requirements. The opposing fabric ends should be easily joined during installation using, for example, an on-machine seam such as a woven back pin seam or a streamline seam, which is non-marking and provides little discontinuity in fabric properties. The fabric should also be economical to produce, with one fabric weave design ideally being able to accommodate a range of product requirements.

Although numerous attempts have been made to design and produce fabrics having the these qualities, none have been entirely successful in simultaneously satisfying all of these criteria.

Thompson, in U.S. Pat. No. 4,423,755 describes a papermaking machine forming fabric having a repeating pattern of floats on its paper side surface. Relatively smaller diameter round surface "floater" yarns are interspaced between the conventional, larger diameter, machine or cross-machine direction yarns to impart stretch resistance to the fabric and additional support for the paper sheet. The floater yarns are preferably arranged in the machine direction and serve to define a continuous planar surface above and parallel to the central plane of the fabric, and below and parallel to the plane defined by the surface floats. The floater yarns may be used in virtually any conventional papermakers' weave pattern, other than a plain weave, that is characterized by the presence of surface floats. The floater yarns do not interlace—as that term is defined by Thompson—with any other yarns running transverse to them. There is no disclosure of the use of shaped or hollow floater yarns for the purposes of controlling fabric air permeability, improving surface smoothness, controlling pin seam loop length, fabric stability or cross machine direction stiffness.

By inserting between adjacent primary weft yarns shaped secondary weft yarn monofilaments which are not as thick as the primary weft yarns, so that they are beneath and in supporting contact with the paper side warp yarns in the woven fabric, in a fashion similar to that described in U.S. Pat. No. 4,423,755, it is has been found that it is possible to construct the fabric so as to control fabric properties, such as air permeability, paper contact area, caliper, neutral line position, stability and cross machine direction stiffness in a manner which greatly improves the economy of fabric manufacture. It is now possible to select the dimensions of secondary weft yarns incorporated into a standard weave design to control fabric air permeability, while maintaining the weft yarn count substantially constant over a range of fabric air permeabilities. Thus, by means of this invention, it is now possible to select the fabric weave design, including the primary weft yarn count, so as to optimize the sizing of the pintle receiving loops formed for a woven back pin seam (the primary weft yarn count is the fabric parameter primarily controlling the pintle loop size), and then to select the dimensions of the secondary weft so as to provide the desired air permeability.

A significant benefit provided by the fabrics of this invention relates to their use in high speed papermaking machines including single tier and unirun dryer sections, for example as described in U.S. Pat. No. 5,062,216. In these machines, the wet paper sheet is in substantially continuous contact with the dryer fabrics in the dryer section, and the wet paper sheet is often subjected to stretching and relaxation as the supporting dryer fabrics wrap around the surfaces of the dryer cylinders, vacuum rolls, and guide rolls, which do not all have the same diameter. When the paper sheet is between the fabric and the roll, and is in contact with the roll, the sheet speed is lessened, whilst when it is outside the fabric, and the fabric is in contact with the roll, the sheet speed is increased. As a result, the sheet undergoes repeated tensioning and relaxation as it passes through the dryer section. The amount of tension to which the sheet is subjected is a function of both the caliper of, and the position of the neutral line within, the dryer fabric.

In the dynamic conditions prevailing in a dryer section, the neutral line region of the fabric travels at a constant speed, regardless of both the bending direction, and the bending diameter. It is desirable to construct the fabric in such a way that the neutral line is positioned close to the paper side surface of the fabric, so as to minimise both paper side surface speed differences and fabric flutter, to minimise paper sheet stretching and relaxation, and to minimise any propensity for paper sheet breaks.

For the purposes of this invention, the following definitions are important:

(a) "primary yarns" refers to those warp or weft yarns, which in their turn are referred to as "primary warp yarns" and "primary weft yarns", that form an integral part of the basic weave pattern of the fabric; the basic weave pattern substantially defines the fundamental mechanical structure, warp and weft interlacing pattern and the general surface characteristics of the fabric;

(b) "secondary weft yarns", refers to weft yarns that are located between adjacent primary weft yarns that lie interior to, and beneath, at least one primary warp yarn float that traverses (or "floats") over two or more primary weft yarns in the weave pattern;

(c) "thickness" and "width" refer to the cross sectional dimensions of the yarns: thickness is measured in a direction substantially perpendicular to the plane of the fabric, and width is measured substantially perpendicular to thickness;

(d) "yarn count" refers to the number of primary yarns, only, in a given direction in the fabric; in determining a weft yarn count the secondary weft yarns are not included;

(e) "machine direction" means a direction substantially parallel to the direction of motion of the fabric in the machine, and "cross machine direction" means a direction substantially perpendicular to the machine direction;

(f) "paper side" refers to the surface of the fabric which in use is in contact with the wet paper sheet, or to a surface of a yarn oriented towards the paper side of the fabric, and "machine side" refers to the other surface of the fabric, or to a surface of a yarn oriented away from the paper side surface of the fabric;

(g) "aspect ratio" refers to the ratio of the width of a monofilament to its thickness;

(h) "neutral line" refers to the region within the fabric, between the machine side surface and the paper side surface, that undergoes zero strain when the fabric bends as it is wrapped around the dryer section rolls, which do not all have the same diameter; the neutral line always travels at the same speed regardless of the fabric radius of curvature; and (i) "solidity" in the context of a hollow monofilament refers to the proportion of the cross sectional area that is occupied by the yarn material: thus at 75% solidity three quarters of the cross sectional area is occupied by the yarn material.

SUMMARY OF THE INVENTION

The present invention seeks to provide a papermakers fabric, wherein the weave design includes at least one layer of machine direction monofilament primary warp yarns and at least one layer of cross-machine direction monofilament primary weft yarns interwoven according to a weave pattern that provides for exposed floats of the primary warp yarns on the paper side surface of the fabric, and further includes at least one layer of cross machine direction monofilament secondary weft yarns, wherein in the finished fabric:

a) each secondary weft yarn is located between two adjacent primary weft yarns;

b) the secondary weft yarns have a cross-sectional profile including at least one substantially flattened surface;

c) the secondary weft yarns are oriented so that the at least one substantially flat surface is on the paper side thereof beneath, and in supporting contact with, the machine side of the exposed floats of the primary warp yarns in the paper side surface of the fabric; and d) the secondary weft yarns have a thickness in a direction substantially perpendicular to the paper side of the fabric that is less than one-half the thickness of the primary weft yarns in the same direction.

DETAILED DESCRIPTION OF THE PREFERRED EMBODIMENTS

The secondary weft yarns used in the fabrics of this invention are woven into the fabric between adjacent primary weft yarns, in a position substantially as described in U.S. Pat. No. 4,423,755. During weaving, the secondary weft yarns are oriented so as to present the at least one substantially flattened surface in the secondary weft yarn cross sectional profile in contact with the machine side of the paper side warp yarns in the woven fabric. The orientation of the shaped secondary weft yarns may be assured during the weaving process, and in the finished fabric, by utilizing a flat weft insertion device, such as is described in Brouwer et al. U.S. Pat. No. 3,464,452 and Charbon, FR 1,510,153, or other similar device.

The dimensions of the secondary weft yarns are critical to success in realizing all of the benefits of this invention. In particular, the secondary weft yarns must have a significantly reduced thickness when compared to the primary weft yarns. In the finished fabric, the thickness of the secondary weft yarns is less than one-half the thickness of the primary weft yarns in the same direction. Otherwise, the secondary weft yarns may not be positioned in supporting contact with the machine side of the exposed floats of the machine direction primary warp yarns in the paper side surface of the woven fabric. If hollow monofilaments are used as the shaped secondary weft yarns the initial monofilament thickness may be greater than one-half their thickness since such yarns will deform to a lower thickness during heat setting of the fabric. However, if a hollow monofilament is used, a balance has to be made between the physical requirements imposed by the weaving process, and adequate deformability. It appears that solidities in the range of from about 50% to about 80% are acceptable.

The cross sectional shape of the secondary weft yarns in the finished fabric contributes significantly to the air permeability properties of the fabric. If it is chosen to fill closely the available space between the adjacent primary weft, the maximum reduction in fabric air permeability is obtained. By choosing the width of the shaped yarns carefully, the degree of air permeability can be preselected at the weaving stage.

By "shape" we refer to cross-sectional yarn profiles which may include, but are not limited to, squares, rectangles, ovals or ellipses, "D" shapes, triangular cross sectional profiles, or hollow cross section yarns of these and similar shapes, and any other profile which can present a relatively flat surface to the machine side of the exposed floats of machine direction primary warp yarns in the finished paper side surface of the fabric when properly oriented during the weaving process.

The primary warp yarns are solid monofilaments, and preferably in the finished fabric have a cross sectional profile that is substantially flattened. Thus, for example, a square cross section profile primary warp yarn can be used. Preferably, the aspect ratio of the primary warp yarns in the finished fabric is at least about 1.5:1, and more preferably, the aspect ratio of the primary warp yarns is at least about 2:1.

It is also possible to use shaped primary weft yarns, with the proviso that the relationship between the thicknesses of the primary and secondary weft yarns is maintained in the finished fabric. A shaped primary weft yarn may also be substantially flat, elliptical, or circular, or a combination of such shapes may be used.

It has been found that the most satisfactory results are obtained when all of the primary weft yarns have a substantially circular cross sectional profile, and the cross sectional profile of the secondary weft yarns is chosen from the group consisting of a solid or hollow square, rectangle, oval, ellipse, "D" shape, and triangle.

By careful selection of the size and shape of the secondary weft yarns, it is now possible to manufacture fabrics having a lower yarn count in both the machine and cross-machine directions, while providing the same air permeability as a comparable fabric having a higher yarn count. The fabrics of this invention are thus more economical to manufacture than comparable fabrics having the same air permeability, as they require fewer cross-machine direction strands per unit of machine direction length. It is also now possible to reduce the caliper of multiple layer fabrics, such as those having two or three layers of warp or weft yarns, to a caliper that is comparable to that of a single layer prior art fabric having the same air permeability. Such low caliper fabrics would be suitable for use, for example, in single tier or serpentine dryer sections, such as those substantially as described in U.S. Pat. No. 5,062,216. Because the secondary weft yarns are located just below the paper side surface of the fabric, and because the finished fabric is of a lower caliper, the neutral line of the fabrics of this invention is relatively close to the paper side surface. This reduces significantly paper sheet stretching, paper sheet breaks, and flutter.

In addition, selection of the width of the secondary weft yarns provides the manufacturer with greater control when creating pintle loops to form the woven back pin seam, or to attach the spiral coils of a so-called "streamline seam", used to join the fabric ends than was hitherto possible, without sacrificing any of the physical properties of the fabric.

The fabrics of this invention are flat woven according to a weave pattern that provides for exposed floats of the machine direction primary warp yarns in the paper side surface of the fabric, into which the secondary weft yarns may be inserted between adjacent primary weft yarns during weaving. The only weave designs to which this invention is not applicable are those in which the fabric, or the paper side layer of a multilayer fabric, is a plain weave.

It is a further feature of this invention that, by careful selection of the width of the secondary weft yarns, it is now possible to make adjustments to the length of the pintle retaining loops of a pin seam used to join the opposing fabric ends during installation while, at the same time, maintaining fabric air permeability within a desired range.

The pintle retaining loops of a woven back pin seam are formed by weaving back the ends of some of the fabric warp yarns into a nearby path in the fabric, in registration with the fabric weave pattern. This technique is well known and is described, for example, in Scarf, U.S. Pat. No. 5,458,161. In a streamline seam, the warp yarns are used to retain a helical joining element incorporated into each of the opposing fabric ends. During installation, the opposing helices are interdigitated, and a pintle inserted through both helices to close the seam. Seams of this type are described by Smolens, U.S. Pat. No. 4,791,708; Brindle et al, GB 2,178,766 and by Krenkel et al, U.S. Pat. No. 4,985,790.

It is highly desirable that such seams should be non-marking. Seam marking can be caused in the dryer section by differential drying rates resulting from changes in air permeability in the seam area when compared to the body of the fabric, or by the excessive pressure of any raised portions of the seam against the paper sheet as the fabric carrying the paper sheet wraps around the dryer cylinders. It is well known that a pin seam having relatively short pintle retaining loops, and which is closed by a pintle of the proper size, will reduce any marking tendency. In general, the seam should provide as little difference as possible, with regard to both air permeability and caliper, when compared to the remainder of the fabric.

The present invention offers a simple and elegant solution to this requirement. It is often difficult to provide a pin seam having relatively short pintle retaining loops because of the need to weave back the fabric warp ends so as to be in registration with the existing fabric weave pattern in order to reduce seam marking and minimize any discontinuity of fabric properties. By careful selection of the size of the secondary weft yarns inserted into the fabric weave, and used to control fabric air permeability, the machine direction length of the weave repeat may now be adjusted so as to increase or decrease the machine direction length of the pintle loops while maintaining the desired fabric air permeability. It appears that, in general, the length of the pintle retaining loops is proportional to the reciprocal of the primary weft count. Conversely, the invention allows the fabric manufacturer to select the dimensions of the secondary weft yarns necessary to provide the desired fabric air permeability while adjusting the yarn density of the primary weft so as to optimize the length of the pintle retaining loops.

BRIEF DESCRIPTION OF THE DRAWINGS

The invention will now be described by way of reference to the drawings in which.

DETAILED DESCRIPTION OF THE DRAWINGS

Figure 1:
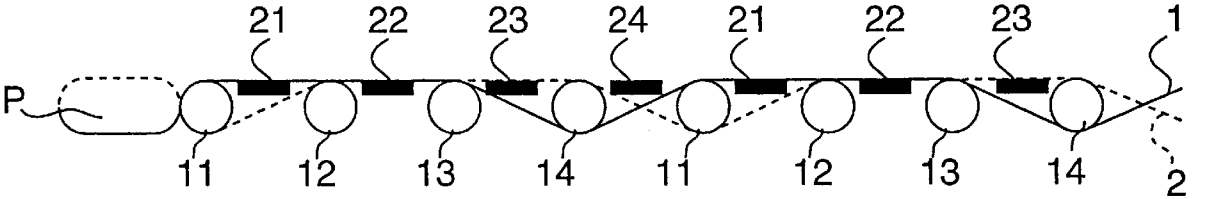
FIGS. 1, 2 and 3 are schematic representations of machine direction cross sections of three fabrics according to the invention.

In all of the following Figures, the primary warp yarns are labelled 1 through 4, the primary weft yarns are labelled 11 through 14, and the secondary weft yarns are labelled 21 through 24. The length of warp yarn forming the pintle retaining loop at one fabric end is labelled P.

Figure 2:
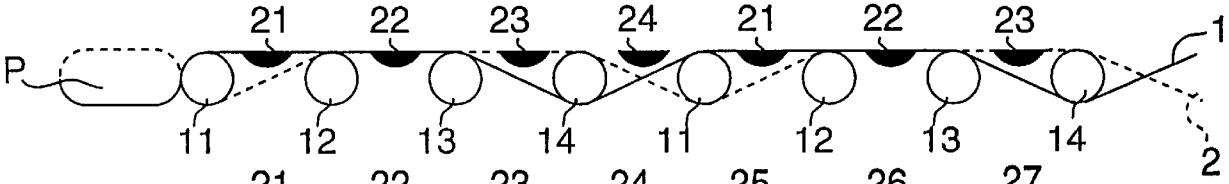
Figure 3:
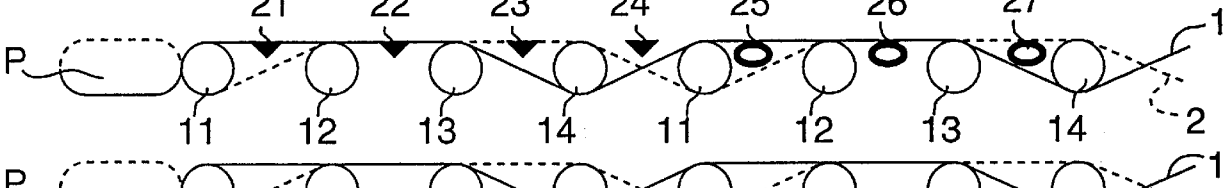
Figure 6:
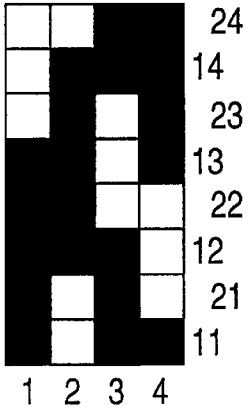
FIG. 6 is a weave diagram of the fabrics illustrated in FIGS. 1–3.

FIGS. 1 through 3 are cross sections, taken along the machine direction, and thus parallel to a typical warp yarn, of one end of three fabrics according to the present invention woven according to the 4-shed weave pattern illustrated in FIG. 6. This weave pattern provides for floats of the primary warp yarns 1 and 2 that extend over more than two adjacent primary weft yarns, for example 12 and 13. In FIGS. 1 through 3, shaped secondary weft yarns 21, 22, 23 and 24 have been inserted between each of the adjacent primary weft yarns 11, 12, 13 and 14 so as to control fabric air permeability. Each secondary weft yarn 21 through 24 is shaped in its cross-sectional profile so that one profile surface, which is substantially flat, is oriented so as to be beneath and in supporting contact with the machine side of the exposed floats of the machine direction primary warp yarns 1 and 2 in the paper side surface of the fabric. The thickness of each of the secondary weft yarns 21 through 24 is less than one-half the thickness of the primary weft yarns 11 through 14. The cross sectional profile of the secondary weft yarns 21 through 24 of FIG. 1 is a rectangle; the profile of these same yarns in FIG. 2 is a "D", and in FIG. 3 is a triangle. The width of the secondary weft yarns 21 through 24 shown in FIG. 1 is greater than that of these same yarns in FIG. 2, which are, in turn, wider than the secondary weft yarns 21, 22, 23 and 24 shown in FIG. 3.

A further possible variation is also shown in the right side of FIG. 3. In this portion of FIG. 3 the secondary weft yarns 25, 26 and 27 shown are hollow monofilaments with a solidity of from 50% to 80%. The hollow monofilaments are inserted in the same way as the solid ones, and will become flattened to a degree to an elliptical shape during heat setting and subsequent finishing, eg by calendering, of the fabric. The secondary weft yarn size, and the solidity, are chosen to obtain the desired level of air permeability.

The pintle retaining loop P is formed as a result of creating a woven back pin seam according to any known process and would receive a pintle wire (not shown) when joining the opposing ends of the fabric during installation on the paper-making machine.

Figure 4:
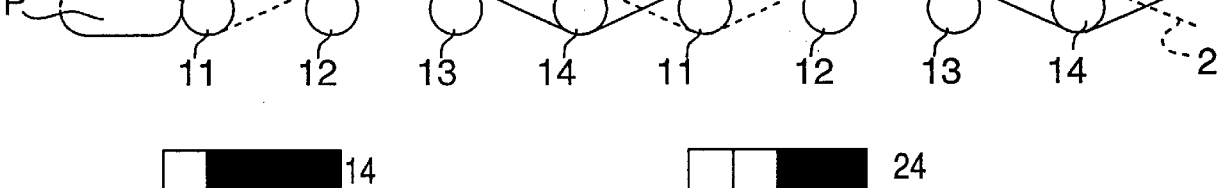
FIG. 4 PRIOR ART
FIG. 4 is a similar cross section of a prior art fabric woven according to the same pattern as the fabrics of FIGS. 1–3 and which does not contain any secondary weft yarns.

The fabric illustrated in FIG. 4 is woven identically to the fabrics shown in FIGS. 1 through 3 with the exception that the shaped secondary weft yarns 21–24 have been omitted.

FIGS. 1 through 4 illustrate the change in open area of the fabric when progressively smaller secondary weft yarns 21 through 24 are inserted between the primary weft yarns 11 through 14, with the maximum open area being in FIG. 4 where there are no secondary weft yarns. As can be seen from the progression of FIGS. 1–4, the fabric of FIG. 4 has a much more open structure and, consequently, a higher air permeability than any of the fabrics shown in FIGS. 1 through 3. FIGS. 1 through 4 also illustrate how fabric air permeability may be adjusted by choosing the size and the shape of the secondary weft yarns 21 through 24 placed between adjacent primary weft 11 through 14.

These Figures serve to illustrate the functionality, and wide applicability of the invention to a variety of fabric designs. Generally speaking, the secondary weft yarns fulfil the following functions:

1) they effectively reduce or close the vertical pathways of the woven structure, thereby reducing fabric air permeability;
2) they provide a means of adjusting air permeability while maintaining both the yarn count and the length of the pintle retaining loops of a woven back pin seam constant;
3) they provide a means of manipulating the machine direction neutral line of the fabric to a position closer to the paper side fabric surface;
4) they provide support to the primary warp floats that pass thereover so as to improve fabric smoothness and increase contact area between the fabric and paper sheet;
5) they provide a cross-machine direction stiffening element at a position that is removed from the centre line of the fabric; and
6) they increase the efficiency of fabric production by reducing the number of weft necessary to meet given fabric specifications of air permeability, stiffness and other properties.

Figure 7:
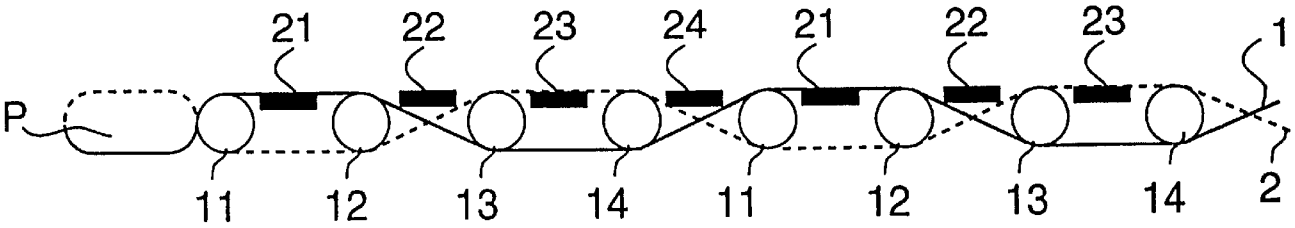
FIG. 7 is a similar cross section of an alternative fabric of this invention.
Figure 8:
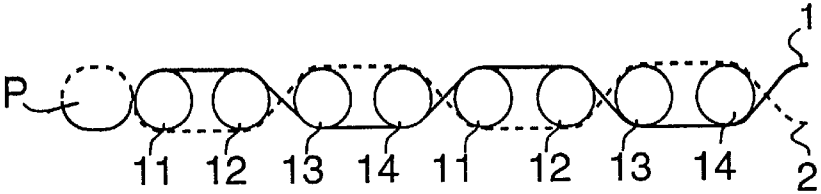
FIG. 8 PRIOR ART
FIG. 8 is a schematic illustration of a prior art fabric whose warp and weft yarns are interwoven according to the same pattern as the fabric of FIG. 7, but which does not contain secondary weft yarns.
Figure 10:
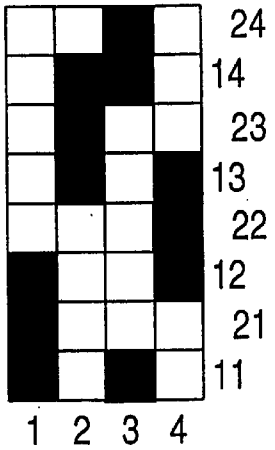
FIG. 10 is the weave diagram of the fabric illustrated in FIG. 7.
Figure 9:
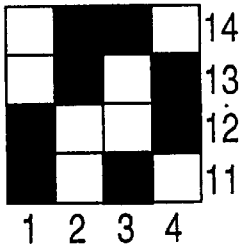
FIG. 9 PRIOR ART
FIG. 9 is the weave diagram of the fabric illustrated in FIG. 8.

FIG. 7 illustrates an alternative fabric design to that shown in FIGS. 1 through 3 which also incorporates the secondary weft yarns. The weave pattern of the fabric illustrated in FIG. 7 is shown in FIG. 10, and FIG. 8 shows the fabric illustrated in FIG. 7, but which does not contain any secondary weft yarns. The weave pattern of this fabric is shown in FIG. 9. Both fabrics are woven according to the same design, and both have the same air permeability. However, due to the necessity of having to increase the primary weft yarn count of the fabric shown in FIG. 8, so as to provide the same air permeability as the fabric of FIG. 7, the length of the pintle loop P has been considerably shortened. This is due to the fact that, when a woven back pin seam is formed, it is necessary to re-weave the loop forming yarns back into registration with the weave pattern of the fabric, as has been previously discussed.

EXAMPLES

Figure 5:
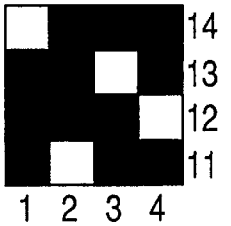
FIG. 5 PRIOR ART
FIG. 5 is a weave diagram of the prior art fabric of FIG. 4.

Three fabrics were woven according essentially to the design shown in FIG. 6, and a fourth fabric was woven to the design in FIGS. 4 and 5. These fabrics are identified as fabrics #1–#4 in the Table below. Fabrics #1, #2 and #3 were woven using the design shown in FIG. 6; fabric #4 was woven to the design in FIG. 8 as a control. The three test fabrics #1, #2 and #3 include flattened secondary weft monofilaments, which are absent from fabric #4. In each of these three fabrics the secondary weft are of rectangular cross section, and are incorporated into the fabric with the longer side of the rectangle beneath and in supportive contact with the primary warps. The test fabrics include secondary wefts of different widths: the secondary weft aspect ratio is therefore different in each fabric. In all four fabrics all of the yarns used are polyethylene terephthalate polyester monofilaments.

All four fabrics were woven to the same primary warp and primary weft yarn counts, using the same primary warp and primary weft monofilament yarns. All four fabrics were finally processed and heat set under the same conditions. The air permeability and cross machine direction stiffness were then determined for each fabric as follows:

(a) air permeability was determined according to ASTM Standard Test Method D 37, using a Frasier air permeometer, model 244 (available from Frasier Precision Instruments, Silver Springs, Md., USA); and
(b) fabric stiffness was determined using a Gurley Stiffness Tester, Model 4171-D, according to the standard operating procedure for that Tester (available from Teledyne Gurley, Troy, N.Y., USA).

All other fabric parameters were determined according to standard measurement procedures.

In Table 1, the yarn count is given as primary warp yarns×primary weft yarns per centimeter in each case; the yarn dimensions are in millimeters; the air permeability is in cubic meters per square meter per hour; the stiffness is in grams; and the fabric caliper is in millimeters. The primary warp aspect ratio in all four fabrics is 2:1.

TABLE 1

Fabric Air Permeability and Stiffness.

| | Fabric #1 | Fabric #2 | Fabric #3 | Fabric #4 |
|---|---|---|---|---|
| Yarn Count | 17.3 × 7.3 | 17.3 × 7.3 | 17.3 × 7.3 | 17.3 × 7.3 |
| Primary Weft | 0.80 | 0.80 | 0.80 | 0.80 |
| Secondary Weft | 0.203 × 0.406 | 0.203 × 0.559 | 0.203 × 0.737 | n/a |
| Aspect Ratio, Secondary Weft | 2:1 | 2.75:1 | 3.63:1 | |
| Primary Warp | 0.33 ×. 0.66 | 0.33 × 0.66 | 0.33 × 0.66 | 0.33 × 0.66 |

TABLE 1-continued

Fabric Air Permeability and Stiffness.

| | Fabric #1 | Fabric #2 | Fabric #3 | Fabric #4 |
|---|---|---|---|---|
| Air Permeability | 2,750 | 1,850 | 1,490 | 5,850 |
| Stiffness | 51.2 | 54.0 | 59.7 | 42.6 |
| Caliper | 1.47 | 1.50 | 1.54 | 1.45 |

These test results show clearly that the fabric air permeability decreases when the secondary weft are used, and decreases as the secondary weft width increases. The cross machine direction fabric stiffness increases when the secondary weft are used, and increases as the weft width increases.

The observed marginal increase in fabric caliper in the test fabrics appears to be due to machine direction cupping or bending in the secondary weft yarns. This effect could be minimised by using a more flexible secondary yarn.

To determine the effect of the presence of secondary weft yarns on the location of the neutral line, five fabrics were compared. In order to make this comparison, the following test method was used to locate the neutral line position in each of the fabrics.

Two parallel lines are drawn separated from each other in the machine direction of the fabric, on both the paper side, and the machine side. The distance between both pairs of lines is measured with the fabric flat, and under a tension representative of the tension under which the fabric will be used: for a dryer section fabric a typical tension is 1.8 kN/m. The fabric is then wrapped around a roll of known diameter with its machine side in contact with the roll, and the same tension applied. The distance between the paper side lines is then measured, to give a "sheet outside" value. The fabric is removed and replaced with the paper side of the fabric in contact with the roll, the same tension applied, and the distance between the machine side lines is then measured, to give a "sheet inside" value. The caliper of the fabric is also measured, on the fabric without any applied tension. In practise it has been found that the tension has a minimal effect on the fabric caliper value. The following equation then provides the location of the neutral line as a percentage of the fabric caliper, from the outside surface of the fabric towards the roll, which is also towards the center of curvature of the fabric.

$$NL = \left[ \frac{Lr - L}{Lr} \times \frac{d}{2t} \right] \times 100$$

where:

L=distance between lines, under tension, fabric flat;

Lr=distance between lines, under tension, fabric wrapped about roll;

d=diameter of roll; and t=fabric caliper.

All of L, Lr, d and t are measured in millimeters. The results are given in Table 2. In Table 2, fabric #5 is woven to a design substantially the same as that in FIG. 6. Fabric #6 is a double layer symmetrical dryer fabric that does not include secondary weft. Fabrics #7, #8 and #9 all include round secondary weft yarns. Fabric #7 is a single layer design including two warp yarn systems, and with a round secondary weft yarn between each primary weft yarn. Fabrics #8 and #9 are similar to those shown in FIG. 6, but with the inclusion of round secondary weft instead of rectangular. In all of the fabrics, the yarns are polyethylene terephthalate polyester monofilaments. In Table 2 the yarn count is as in Table 1, and the yarns sizes are in millimeters. In Table 2 the neutral line caliper distances refer to the distance of the neutral line from the paper side surface under the conditions given.

TABLE 2

| | Fabric #5 | Fabric #6 | Fabric #7 | Fabric #8 | Fabric #9 |
|---|---|---|---|---|---|
| Yarn Count | 16.9 × 8.3 | 17.9 × 13.4 | 22.8 × 8.3 | 20.5 × 8.3 | 20.5 × 8.5 |
| Primary Weft size | 0.80 | 0.50 | 0.90 | 0.80 | 0.70 |
| Secondary Weft Size | 0.203 × 0.406 | n/a | 0.55 | 0.30 | 0.30 |
| Fabric Caliper | 1.4 | 1.88 | 1.4 | 1.45 | 1.42 |
| NL, Sheet Inside | 40.0% | 50.0% | 50.0% | 40.0% | 40.0% |
| NL, Sheet Outside | 80.0% | 50.0% | 50.0% | 75.0% | 65.0% |
| NeutraL Line Caliper Sheet Inside | 0.56 mm | 0.94 mm | 0.71 mm | 0.58 mm | 0.56 mm |
| Neutral Line Caliper Sheet Outside | 0.28 mm | 0.94 mm | 0.71 mm | 0.36 mm | 0.51 mm |
| Total Neutral Line Caliper | 0.84 mm | 1.88 mm | 1.42 mm | 0.94 mm | 1.07 mm |

In a dryer fabric it is desirable that the neutral line position, particularly in fabrics intended for high speed papermaking machines including unirun or single tier dryer sections, be positioned near to the paper side of the fabric so as to minimise speed differences in the paper as the paper and the fabric wrap about the various dryer section rolls, and to reduce fabric wear. The amount of paper sheet stretching that occurs is a function of the fabric thickness and the position of the neutral line within the fabric.

In a symmetrical fabric design, the neutral line is positioned in the middle of the fabric, essentially half way between the paper side and machine side faces of the fabric. In an asymmetric fabric, the neutral line is off-center, and is nearer to one of the fabric faces. In the asymmetric fabrics of this invention the neutral line is located closer to the paper side surface of the fabric: this helps to reduce paper speed differences between "sheet inside" and "sheet outside" conditions, which reduces paper sheet stretching and the propensity for sheet breaks. In a "sheet outside" condition a low neutral line caliper is desirable; in a "sheet inside" condition a high neutral line caliper is desirable. It was found during testing that the two neutral line caliper distances do not always add to equal the fabric caliper measured on a flat fabric. It appears that the neutral line position depends on the direction in which the fabric is bent, that is to say it is differently located in the "sheet inside" and "sheet outside" conditions. This appears to be due to the behaviour of the yarns interlaced within the fabric when the fabric is bent.

Table 2 shows that the fabrics of this invention have a low neutral line caliper, and a correspondingly high value of NL, in the "sheet outside" condition.

What is claimed is:

1. A flat woven papermakers fabric, having a machine side, a paper side, a neutral bending plane within the fabric between the paper side and the machine side, and two opposed ends which are joined together by means of a seam, wherein the weave design includes at least one layer of machine direction monofilament primary warp yarns and at least one layer of cross-machine direction monofilament primary weft yarns having a selected primary weft count interwoven according to a weave design that provides for exposed floats of the primary warps on the paper side surface of the fabric, and further includes at least one layer of cross machine direction monofilament secondary weft yarns, and wherein the seam is chosen for the group consisting of a streamline seam comprising spiral coils engaged with woven back primary warp loops formed in each of the opposed ends and a pintle engaging the spiral coils, and a woven back pin seam comprising woven back primary warp pintle retaining loops and a pintle engaging the pintle loops, wherein:

a) each secondary weft yarn is located between two adjacent primary weft yarns;

b) the secondary weft yarns have a cross-sectional profile including at least one substantially flattened surface;

c) the secondary weft yarns are oriented so that the at least one substantially flat surface is on the paper side of the fabric beneath, and in supporting contact with, the machine side of the exposed floats of the primary warp yarns in the paper side surface of the fabric;

d) the secondary weft yarns have a thickness in a direction substantially perpendicular to the paper side of the fabric that is less than one half the thickness of the primary weft yarns in the same direction; and (e) the length of said woven back primary warp loops is proportional to the reciprocal of the primary weft count.

2. A fabric according to claim 1 wherein the secondary weft is chosen from the group consisting of solid or hollow monofilaments.

3. A fabric according to claim 2 wherein the secondary weft is a solid monofilament having a cross sectional shape chosen from the group consisting of square, rectangular, ellipse, "D" shape, or triangular.

4. A fabric according to claim 2 wherein the secondary weft is a hollow monofilament having a cross sectional shape chosen from the group consisting of square, rectangular, ellipse, "D" shape, or triangular, and the hollow monofilament has a solidity of from 50% to 80%.

5. A fabric according to claim 1 wherein the neutral plane is closer to the paper side than the machine side of the fabric.

6. A fabric according to claim 1 wherein the primary wrap yarn is flattened.

7. A fabric according to claim 6 said flattened primary wrap yarns have an aspect ratio of at least about 1.5:1.

8. A fabric according to claim 7 wherein the aspect ratio is at least about 2:1.

9. A fabric according to claim 1 said secondary weft yarns have an aspect ratio of at least about 1.5:1.

10. A fabric according to claim 9 wherein the aspect ratio is at least about 2:1.

11. A fabric according to claim 1 wherein the primary wefts are solid monofilaments having a substantially circular cross section.

12. A fabric according to claim 11 wherein the secondary wefts are solid monofilaments having a cross sectional shape chosen from the group consisting of square, rectangular, ellipse, "D" shape, or triangular.

13. A fabric according to claim 11 wherein the secondary wefts are hollow monofilaments having a cross sectional shape chosen from the group consisting of square, rectangular, ellipse, "D" shape, or triangular and the hollow monofilament has a solidity of from 50% to 80%.

14. A fabric according to claim 1 wherein the primary warp yarns float over at least two primary weft yarns.

* * * * *